US005291669A

United States Patent [19]

Khoury et al.

[11] Patent Number: 5,291,669

[45] Date of Patent: Mar. 8, 1994

[54] SHOE PRESERVERS

[75] Inventors: Amin Khoury, Wellesley, Mass.; Christie Phelps, Danbury, N.H.

[73] Assignee: Rochester Shoe Tree Co., Inc., Ashland, N.H.

[21] Appl. No.: 750,990

[22] Filed: Aug. 28, 1991

[51] Int. Cl.[5] ..... B43L 17/04

[52] U.S. Cl. ..... 34/95.1; 34/105; 34/9; 36/1; 12/128 B

[58] Field of Search ..... 34/95, 95.1, 104, 105, 34/103, 60, 9; 36/1, 3 R, 3 B, 132, 136; 12/128 R, 128 B; 422/5

[56] References Cited

U.S. PATENT DOCUMENTS

| | | | |
|---|---|---|---|
| 262,217 | 8/1882 | Foster | 34/95.1 |
| 625,143 | 5/1899 | Busky | 12/128 |
| 857,734 | 6/1907 | Hansen | 12/128 |
| 896,536 | 8/1908 | Hayden | 12/128 |
| 2,173,528 | 9/1939 | Beale | 12/128 |
| 2,210,862 | 8/1940 | Tronstad | 34/95.1 |
| 2,446,904 | 8/1948 | Brush | 12/128 |
| 2,460,405 | 2/1949 | Abrams et al. | 12/128 |
| 2,469,468 | 5/1949 | Judd | 34/104 |
| 2,671,277 | 3/1954 | Montgomery | 34/95.1 |
| 3,000,067 | 9/1961 | Hanflig | 36/1 |
| 3,131,036 | 4/1964 | Hirschberg | 34/95.1 |
| 3,482,335 | 12/1969 | Ornsteen | 36/1 |
| 4,624,060 | 11/1986 | Maxwell | 36/1 |
| 4,774,769 | 10/1988 | Dollst | 34/60 |
| 4,981,651 | 1/1991 | Horng | 34/104 |

*Primary Examiner*—Henry A. Bennett
*Assistant Examiner*—Denise Gromada
*Attorney, Agent, or Firm*—Cumpston & Shaw

[57] ABSTRACT

A shoe preserver having a wicking portion and an absorbing portion retained within a flexible porous covering. The preserver is sized to substantially fill the volume defined by the interior of the shoe. A pair of preservers is interconnected by a flexible strap attached to the forward portion of the preserver such that upon insertion into the shoe, the shoe and preserver may be carried by the strap.

4 Claims, 3 Drawing Sheets

SHOE PRESERVERS

The present invention relates to shoe preservers, and more particularly, to shoe preservers having a wicking member for drawing moisture from the interior of a shoe and an absorbing member for retaining moisture withdrawn from the interior of the shoe. The invention also relates to a carrying strap connecting a pair of shoe preservers such that upon insertion of a preserver in a shoe, the shoe and preserver may be readily carried by the strap.

BACKGROUND OF THE INVENTION

U.S. Pat. No. 3,131,036 to Hirschberg discloses a shoe drying device having a porous semi-rigid plastic foam wherein the foam defines a cavity which is filled with a powdered dessicant material.

U.S. Pat. No. 896,536 to Hayden discloses a shoe tree having an absorbent sponge material surrounded by a porous fabric, wherein a wooden block or piece is disposed within the sponge material to provide for insertion and removal of the shoe tree.

U.S. Pat. No. 2,173,528 to Beale discloses a disinfectant pad including an absorbent material enclosed by a porous covering.

SUMMARY OF THE INVENTION

The present invention includes a pair of shoe preservers for a pair of shoes, wherein each preserver includes a flexible porous covering which encloses a wicking member and an absorbing member. The wicking member includes a wicking material for withdrawing moisture from the interior of the shoe. The absorbing member includes an absorbing material for absorbing and retaining moisture from the wicking member and the interior of the shoe. Each preserver includes a toe end and a heel end such that upon operable insertion within a shoe, the toe end contacts the toe of the shoe, and the heel end contacts the heel of the shoe. Preferably, the wicking member is located in the toe end of the preserver and the absorbing member is in the heel end of the preserver.

The preservers in each pair are interconnected by a flexible strap. The strap is affixed proximal to the toe end such that upon insertion of the preserver into the shoe, an acute angle is formed within the shoe between the preserver and the strap. The acute angle provides that upon a longitudinal force along the strap, a sufficient force is transferred through the preserver towards the heel of the shoe to effectively lock the preserver into the shoe, thereby allowing the shoe to be carried by the strap.

DETAILED DESCRIPTION OF THE PREFERRED EMBODIMENT

Figure 1:
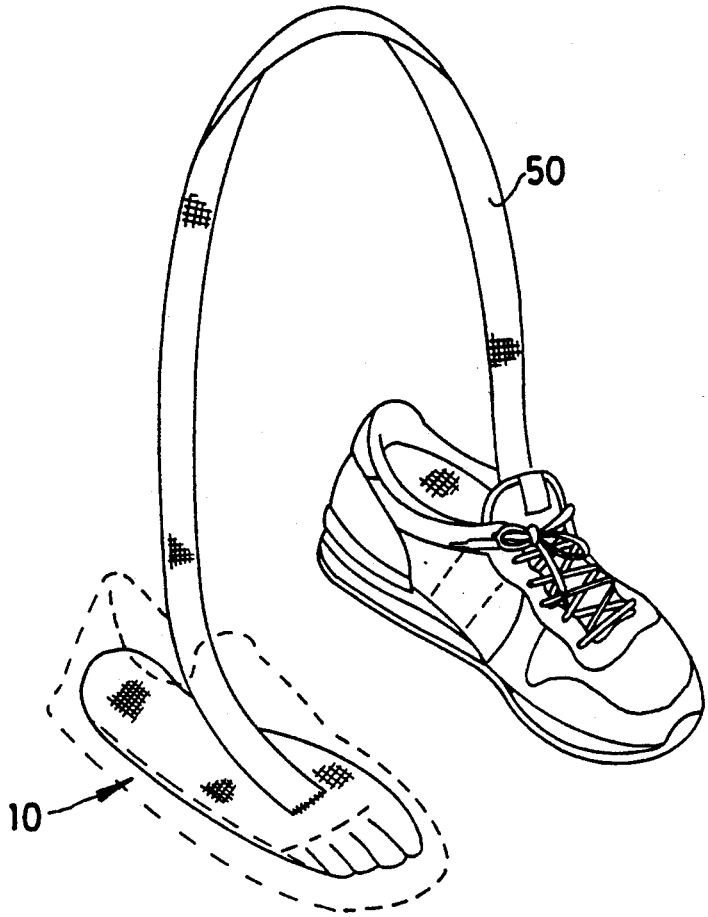
FIG. 1 is a perspective view of a pair of shoe preservers cooperatively engaged in a pair of shoes.

Referring to FIGS. 1–4, the present invention includes a pair of shoe preservers 10 having a porous flexible covering 20, a wicking member 30, an absorbing member 40 and an interconnecting strap 50.

Figure 2:
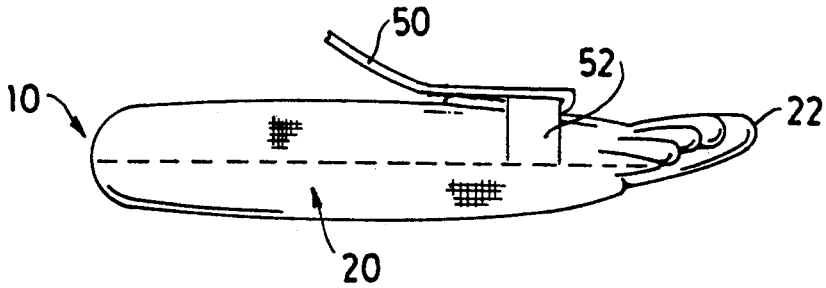
FIG. 2 is a right side elevational view of a shoe preserver.
Figure 3:
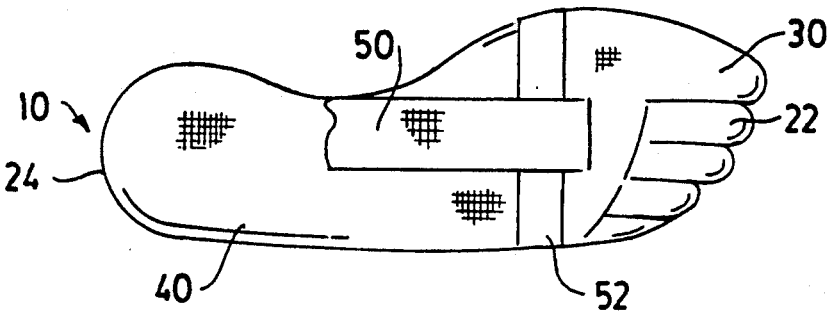
FIG. 3 is a top plan view of a shoe preserver.
Figure 4:
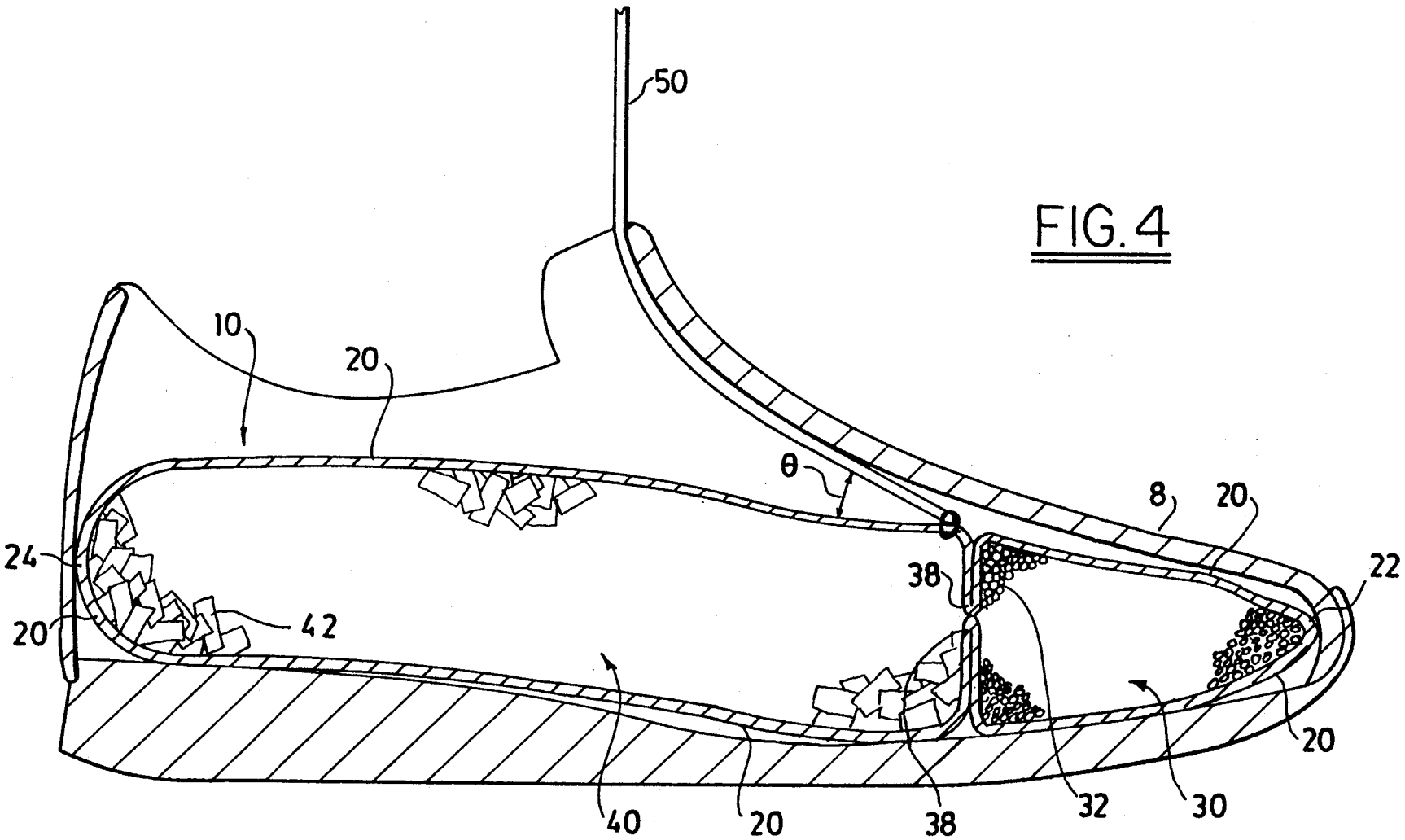
FIG. 4 is a longitudinal cross sectional view showing the preserver and a portion of the strap operably engaged with a shoe.
Figure 8:
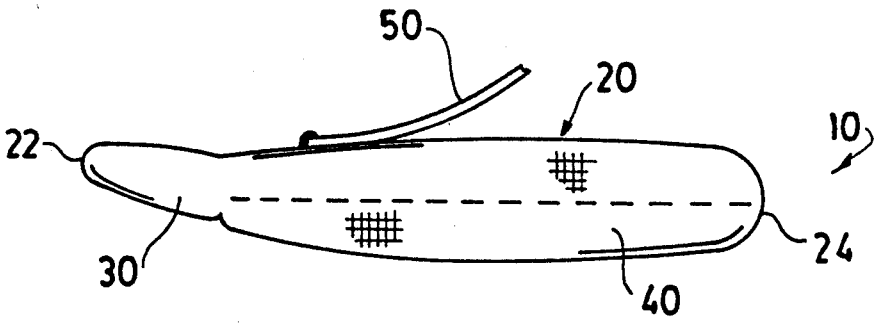
FIG. 8 is a left side elevational view of a shoe preserver.
Figure 5:
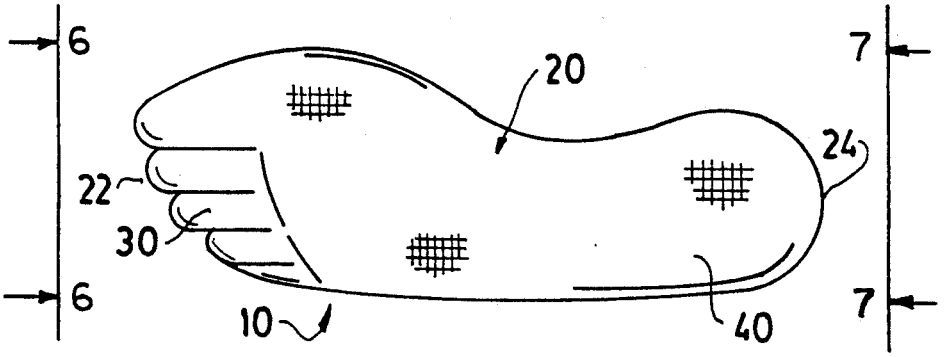
FIG. 5 is a bottom plan of a shoe preserver.
Figure 6:
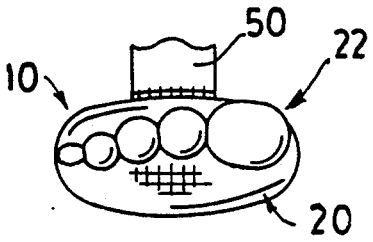
FIG. 6 is a front elevation view of a shoe preserver taken along lines 6—6 of FIG. 5.
Figure 7:
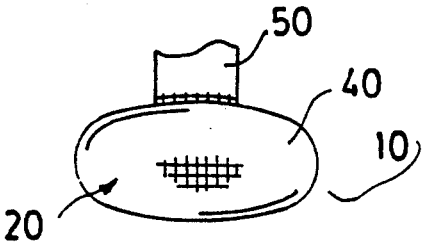
FIG. 7 is a rear elevational view of a shoe preserver taken along lines 7—7 of FIG. 5.

As shown in FIG. 4, the covering 20 is sized and configured to substantially fill the volume defined by the interior of a shoe 8. Referring to FIGS. 1–3, the covering 20 defines a substantially foot shaped volume. The covering 20 includes a toe end 22 sized to be disposed within the toe of the shoe 8 and a heel end 24 sized to contact the heel of the shoe. The covering 20 is formed of a flexible porous material, such as nylon.

Referring to FIG. 4, the wicking member 30 is disposed within the covering 20 proximal to the toe end 22 and includes an open cell foam 32. The foam 32 acts to draw, or wick moisture from the interior of the shoe 8 through the covering 20 and into the foam. Preferably, upon operable insertion of the shoe 8, the wicking member 30 extends from the toe end 22 to underlie a portion of the tongue of the shoe 8.

As shown in FIG. 4, the absorbing member 40 is disposed in the heel end 24 of the preserver 10, such that the absorbing member and wicking member 30 communicate through the covering 20. The wicking member 30 and absorbing member 40 may be separated by a porous interface 38. Referring to FIG. 4, the interface 38 may be formed by a portion of the covering 20 stitched to itself to form separate volumes for the wicking member 30 and the absorbing member 40. The covering 20 may be stitched to itself so that the preserver 10 resembles a foot, as shown in FIGS. 1–6. Alternatively, the porous interface 38 may be a separate component (not shown). The absorbing member 40 withdraws and retains moisture from the wicking member 30 and the interior of the shoe. The absorbing member 40 is an absorbing material 42 such as cedar shavings. In addition, the cedar shavings impart a pleasant odor to the shoe 8.

As shown in FIG. 4, the wicking member 30 is oriented in the toe area 22 and the absorbing member 40 is in the heel area 24. However, the wicking member 30 may substantially surround a portion of, or the entire absorbing member 40.

The interconnecting strap 50 is affixed to each preserver 10 proximal to the toe end 22 by fasteners known in the art, such as snaps, stitches, hook and loop fasteners, or adhesives. Preferably, as shown in FIGS. 2 and 3, a transverse strap 52 extends across the width of the preserver 10. The interconnecting strap 50 is looped around the transverse strap 52 and affixed to itself by snaps, stitching, hook and loop fasteners or adhesives. Alternatively, as shown in FIGS. 1 and 4–8, the interconnecting strap 50 may be affixed directly to the preserver 10. Referring to FIGS. 1–4 and 8, the strap 50 is attached to the preserver 10 sufficiently near the toe end 22 such that upon insertion of the preserver into the shoe 8, the strap and the preserver define an acute angle $\theta$ therebetween. The acute angle $\theta$ provides that upon a longitudinal force along the strap 50, a sufficient force vector is directed through the preserver 10 towards the heel of the shoe 8 so that the preserver is effectively "locked" into the shoe. The effective point of attachment of the strap 50 to the covering 20 precludes removal of the preserver 10, upon a longitudinal force along the strap sufficient to transport the shoe and preserver.

As shown in FIG. 4, one surface of the strap 50 contacts the inside of the shoe 8 along the underside of the tongue, and the other surface of the strap faces the flexible covering 20. The attachment of the strap 50 to the toe portion 22 effectively precludes removal of preserver by applying force at the point of attachment. Upon application of a longitudinal force along the strap 50, the preserver 10 tends to pivot about the heel end 24. However, the toe end 22 wedges within the toe of the shoe and effectively retains the preserver within the shoe 8. To remove the preserver 10, the heel end 24 is first removed from the shoe 8. The removal of the heel end 24 allows for removal of the toe end 22 and strap 50.

While a preferred embodiment of the invention has been shown and described with particularity, it will be appreciated that various changes and modifications may suggest themselves to one having ordinary skill in the art upon being apprised of the present invention. It is intended to encompass all such changes and modifications as fall within the scope and spirit of the appended claims.

What is claimed is:

1. A pair of shoe preservers for shoes having a toe and a heel, comprising:

a) a first and a second preserver, each preserver having a toe end and a heel end; and b) a flexible strap extending between the first and second preserver, the strap being attached to each preserver at a point intermediate of the toe end and the heel end, in which a portion of the strap extending from the point of attachment engages the shoe to generate a force having a component directed substantially towards the heel, the force component being sufficient to preclude removal of the preserver by a longitudinal force incurred along the strap when transporting the shoe and preserver by the strap.

2. The pair of shoe preservers of claim 1, wherein each preserver further comprises:

(a) a wicking member for withdrawing moisture from the shoe; and (b) an absorbing member in communication with the wicking member for retaining moisture withdrawn from the shoe.

3. The pair of shoe preservers of claim 2, wherein the wicking member substantially surrounds the absorbing member.

4. A pair of preservers for shoes, in which the shoes include a toe portion, a heel portion, and a tongue portion, wherein each preserver includes a toe end and a heel end, comprising:

a) a porous flexible covering sized to be received within a shoe;

b) a wicking material within the covering for withdrawing moisture from the shoe;

c) an absorbing material within the covering for retaining moisture withdrawn from the interior of the shoe; and d) an interconnecting flexible strap having a first end attached proximal to the toe end of one preserver and a second end attached proximal to the toe end of the remaining preserver, such that the distance between the attachment of the strap and the toe end of each preserver provides for the formation of an acute angle between the preserver and the strap proximal to the attachment point, in which a portion of the strap extending from the attachment point engages the inside of the shoe adjacent the tongue portion to generate a force having a component pointing substantially towards the heel portion sufficient to preclude removal of the preserver upon exertion of a sufficient longitudinal force along the strap to transport the shoe.

* * * * *